US008826987B2

(12) United States Patent
Watson et al.

(10) Patent No.: US 8,826,987 B2
(45) **Date of Patent: *Sep. 9, 2014**

(54) LOW EQUIVALENT CIRCULATION DENSITY SETTING TOOL

(71) Applicant: Halliburton Energy Services, Inc., Houston, TX (US)

(72) Inventors: Brock Watson, Carrollton, TX (US); Daniel Moeller, Edmond, OK (US); Kevin J. Miller, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/022,200

(22) Filed: Sep. 9, 2013

(65) Prior Publication Data

US 2014/0008080 A1 Jan. 9, 2014

Related U.S. Application Data

(63) Continuation of application No. 12/985,907, filed on Jan. 6, 2011, now Pat. No. 8,555,988.

(51) Int. Cl.
*E21B 34/06* (2006.01)

(52) U.S. Cl.
USPC ..... 166/332.3; 166/373; 166/208; 166/380; 166/386; 166/330; 166/334.2

(58) Field of Classification Search
USPC ..... 166/207, 208, 380, 382, 386, 332.8, 166/330, 332.3, 334.2, 373; 251/352
See application file for complete search history.

(56) References Cited

U.S. PATENT DOCUMENTS

| | | | | |
|---|---|---|---|---|
| RE29,471 | E * | 11/1977 | Giroux | 166/334.2 |
| 4,180,132 | A | 12/1979 | Young | |
| 4,312,406 | A | 1/1982 | McLaurin et al. | |
| 4,687,063 | A | 8/1987 | Gilbert | |
| 4,967,844 | A * | 11/1990 | Brooks et al. | 166/381 |
| 5,159,981 | A | 11/1992 | Le | |
| 6,202,742 | B1 | 3/2001 | Echols | |
| 8,555,988 | B2 * | 10/2013 | Watson et al. | 166/386 |
| 2006/0124311 | A1 * | 6/2006 | Lopez de Cardenas et al. | 166/313 |
| 2009/0107686 | A1 * | 4/2009 | Watson | 166/381 |
| 2009/0173503 | A1 * | 7/2009 | Corbett et al. | 166/373 |
| 2012/0175132 | A1 | 7/2012 | Watson et al. | |

FOREIGN PATENT DOCUMENTS

| | | | |
|---|---|---|---|
| EP | 985797 | A2 | 3/2000 |
| WO | 2008/130876 | A1 | 10/2008 |
| WO | 2012094194 | A3 | 7/2012 |

OTHER PUBLICATIONS

Office Action dated Nov. 30, 2013, U.S. Appl. No. 12/985,907, filed Jan. 6, 2011.
Final Office Action dated Feb. 19, 2013, U.S. Appl. No. 12/985,907, filed Jan. 6, 2011.

(Continued)

*Primary Examiner* — David Andrews
*Assistant Examiner* — Taras P Bemko

(57) ABSTRACT

A downhole oilfield tool assembly comprises a mandrel, a ball valve oriented to block downwards flow through the mandrel in a closed position, a first piston located above the ball valve and at least partly around an outside of the mandrel. The first piston is configured to develop motive force from a pressure differential between an interior of the mandrel and an exterior of the downhole oilfield tool assembly.

20 Claims, 18 Drawing Sheets

(56) References Cited

OTHER PUBLICATIONS

Advisory Action dated Apr. 16, 2013, U.S. Appl. No. 12/985,907, filed Jan. 6, 2011.
Notice of Allowance dated Jun. 7, 2013, U.S. Appl. No. 12/985,907, filed Jan. 6, 2011.
Foreign Communication from a Related Counterpart Application, International Search Report and Written Opinion dated Oct. 29, 2012, International Application PCT/US11/67379 filed on Dec. 27, 2011, 12 pgs.
Foreign Communication from a Related Counterpart Application, International Preliminary Report on Patentability dated Jul. 18, 2013, International Application PCT/US11/67379 filed on Dec. 27, 2011, 5 pgs.
PCT Invitation to Pay Additional Fees dated Aug. 8, 2012, Application Serial No. PCT/US2011/067379.

* cited by examiner

LOW EQUIVALENT CIRCULATION DENSITY SETTING TOOL

CROSS-REFERENCE TO RELATED APPLICATIONS

This application is a continuation of and claims priority under 35 U.S.C. §120 to U.S. patent application Ser. No. 12/985,907, filed on Jan. 6, 2011, entitled "Low Equivalent Circulation Density Setting Tool," by Brock Watson, et al., which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Expandable liner hangers are generally used to secure a liner within a previously set casing or liner string. These types of liner hangers are typically set by expanding the liner hangers radially outward into gripping and sealing contact with the previous casing or liner string. Many such liner hangers are expanded by use of hydraulic pressure to drive an expanding cone or wedge through the liner hanger.

The expansion process is typically performed by means of a running tool or setting tool used to convey the liner hanger and attached liner into a wellbore. The running tool or setting tool may be interconnected between a work string (e.g., a tubular string made up of drill pipe or other segmented or continuous tubular elements) and the liner hanger.

If the liner hanger is expanded using hydraulic pressure, then the running tool or setting tool is generally used to control the communication of fluid pressure and flow to and from various portions of the liner hanger expansion mechanism, and between the work string and the liner. The running tool or setting tool also may be used to control when and how the work string is released from the liner hanger, for example, after expansion of the liner hanger or after an unsuccessful setting of the liner hanger.

The running tool or setting tool may provide for cementing therethrough, in those cases in which the liner is to be cemented in the wellbore. Some designs of the running or setting tool employ a ball or cementing plug that is dropped through the work string at the completion of the cementing operation and prior to expanding the liner hanger. However, at substantial depths and/or in highly deviated wellbores, it may take a very long time for the ball to reach the running or setting tool, during which time cement may be setting up around the drill pipe and potentially causing the drill pipe to get stuck. In addition, the ball may not reach the running or setting tool at all. Furthermore, the cementing plug may not be able to be landed correctly on a corresponding float collar.

SUMMARY OF THE INVENTION

In an embodiment, a downhole oilfield tool assembly is disclosed. The tool assembly comprises a mandrel, a valve oriented to block downwards flow through the mandrel in a closed position, and a first piston located above the valve and at least partly around an outside of the mandrel. The first piston is configured to develop motive force from a pressure differential between an interior of the mandrel and an exterior of the downhole oilfield tool assembly.

In an embodiment, a downhole setting tool is disclosed. The setting tool comprises a ball valve, a collet mandrel rotatably disposed in the setting tool, the collet mandrel comprising collet mandrel teeth, and an actuator collar comprising actuator collar teeth, the actuator collar teeth engaging with the collet mandrel teeth so as to torsionally lock the collet mandrel to the actuator collar, and a first piston situated uphole from the ball valve.

In an embodiment, a method of hydraulically releasing a flapper valve of a setting tool configured to set a liner inside a casing is disclosed. The flapper valve comprises a flapper piston and a spring-loaded flapper mounted to a head of the flapper piston. The setting tool comprises at least one piston situated uphole from the flapper valve, a flapper prop configured to hold the flapper in an open position, a flapper housing inside which the flapper piston is disposed, and a shear screw fixing the flapper piston to the flapper housing. The method comprises pressurizing a space between the flapper piston and the flapper housing and downhole from the head of the flapper piston to a first pressure and pressurizing a space uphole from the head of the flapper piston to a second pressure greater than the first pressure by an amount sufficient to overcome a shear strength of the shear screw. The method further comprises shearing the shear screw, forcing the flapper piston downhole relative to the flapper housing and the flapper prop such that the flapper clears the flapper prop, and closing the flapper.

In an embodiment, a method of setting a liner inside a casing is disclosed. The method comprises actuating a valve to block downwards flow through a setting tool, developing a pressure differential between an interior of the setting tool above the valve and an exterior of the setting tool, and setting the liner inside the casing responsive to the pressure differential.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION OF THE EMBODIMENTS

Figure 1A:
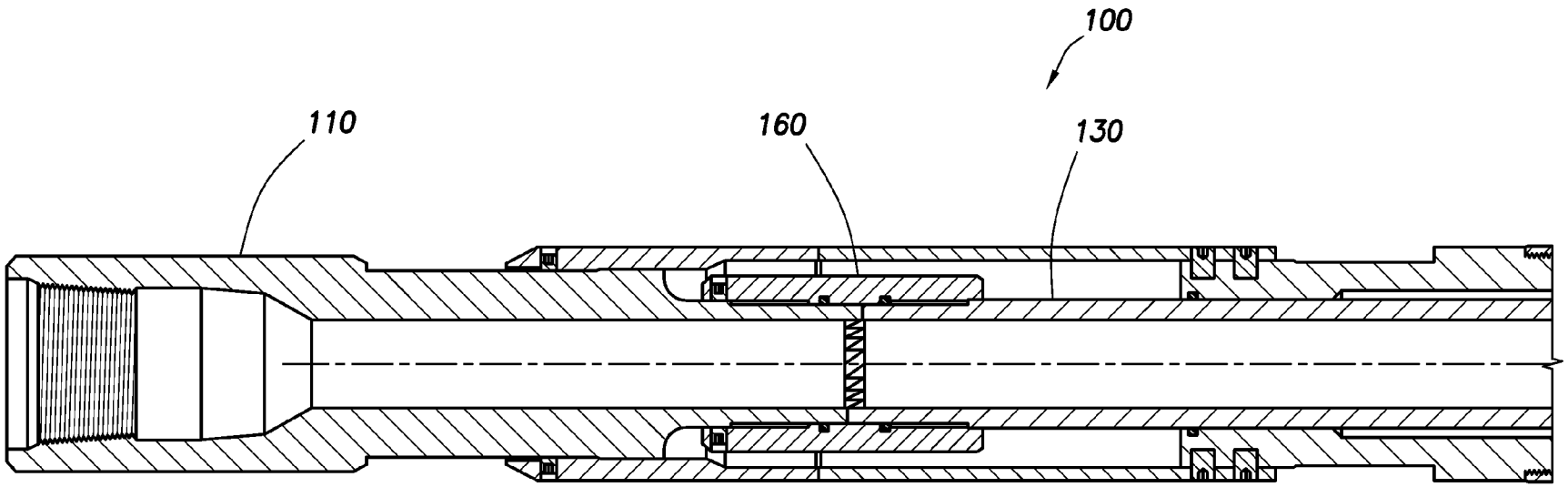
FIG. 1A is a schematic cross-sectional view of a portion of an embodiment of a setting tool.
Figure 1B:
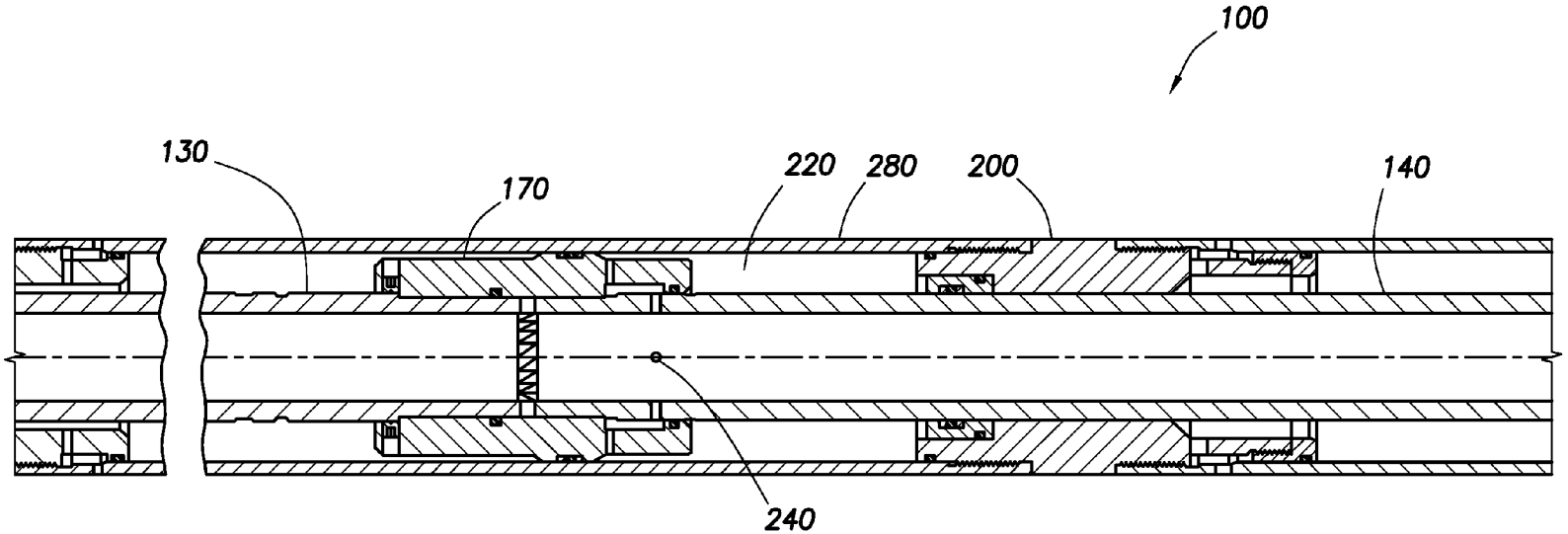
FIG. 1B is a schematic cross-sectional view of a further portion of the embodiment of a setting tool illustrated in FIG. 1A.

It should be understood at the outset that although illustrative implementations of one or more embodiments are illustrated below, the disclosed assemblies and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Unless otherwise specified, any use of the term "couple" describing an interaction between elements is not meant to limit the interaction to direct interaction between the elements and also may include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream" or "uphole" meaning toward the surface of the wellbore and with "down," "lower," "downward," "downstream" or "downhole" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

A downhole tool assembly having a valve located below one or more pistons is disclosed, where in a closed position the valve blocks downwards flow through the downhole tool assembly. In an embodiment, locating the valve below the one or more pistons promotes composing the downhole tool assembly with two or more pistons. Incorporating additional pistons, for example additional piston subassemblies, promotes delivering increased piston force without increasing pressure differentials to excessive amplitudes. For example, when a piston subassembly structure is actuated by the pressure difference between an interior of the downhole tool assembly and an exterior of the downhole tool assembly, coupling a second piston subassembly to the a first piston subassembly may produce two times as much piston force as the first piston subassembly alone, when the pressure difference is fixed. Increasingly heavy gauge liners are being deployed into wellbores, demanding increased force applied to expansion mechanisms and/or expansion cones to expand and hang the liners. It is contemplated that the downhole tool assembly with the valve located below or downhole of the one or more pistons may have application in low equivalent circulation density (ECD) service jobs.

FIG. 1A, FIG. 1B, FIG. 1C and FIG. 1D are schematic cross-sectional views of portions of an embodiment of a setting tool 100 along a length of the setting tool 100. The setting tool 100 may be attached to a downhole end of a work string via an upper adapter 110 and may be used to attach a liner hanger 120 to a casing situated in a wellbore. In addition, the setting tool 100 may be used to convey cement that is pumped down the work string, down an interior of a liner attached to a downhole end of the setting tool 100, and up an annulus situated between the liner and a wall of a wellbore, for the purpose of cementing the liner to the wellbore. In order to be able to convey cement to the annulus and to expand the liner hanger 120, the setting tool 100 may comprise a series of mandrels 110, 130, 140, 150 which are interconnected and sealed by couplings 160, 170, 180. As set forth above, the mandrel 110 also may be referred to as upper adapter 110 and may connect the setting tool 100 to the work string. In addition, a mandrel at a downhole end of the setting tool 100 may be referred to as a collet mandrel 190. The mandrels 110, 130, 140, 150, 190 are capable of holding and conveying a pressurized fluid, e.g., cement slurry, hydraulic fluid, etc.

Figure 1C:
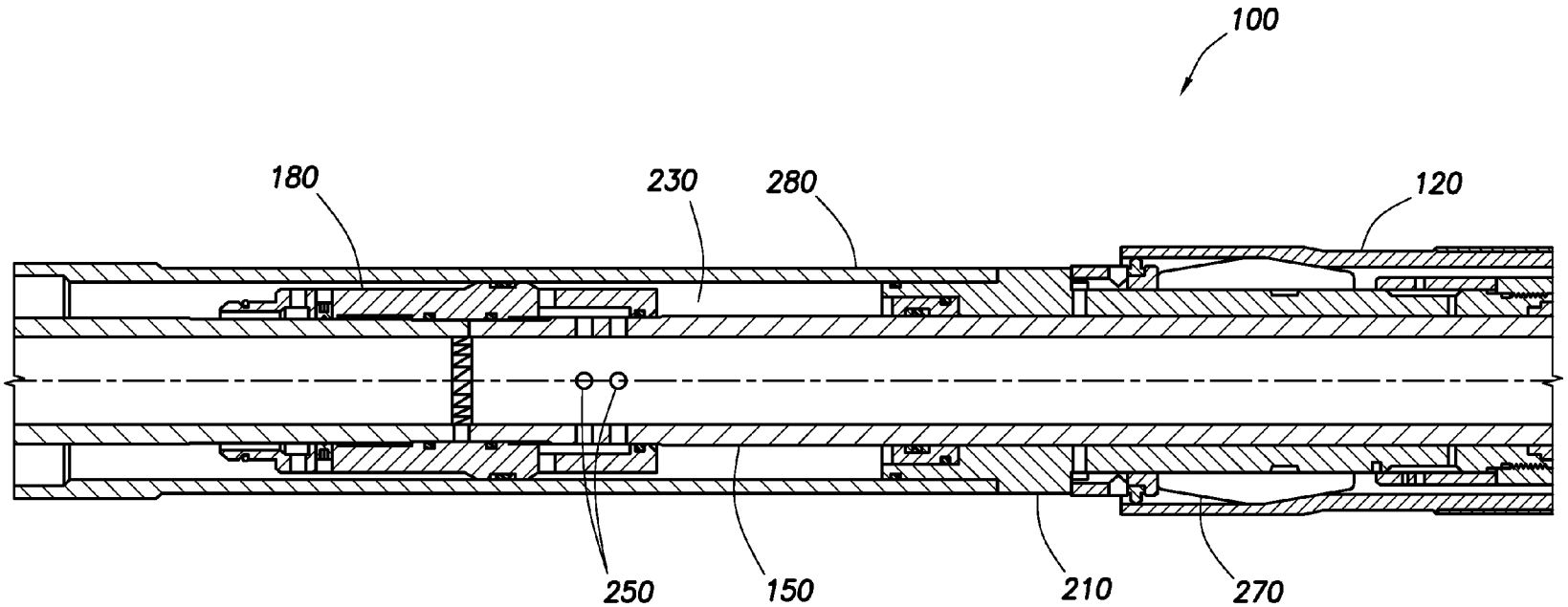
FIG. 1C is a schematic cross-sectional view of a further portion of the embodiment of a setting tool illustrated in FIG. 1A.

In an embodiment, the setting tool 100 may further comprise pistons 200, 210 and respective pressure chambers 220, 230, which are in fluid communication with mandrels 140, 150 via pressurization ports 240, 250, respectively. In addition, the setting tool 100 may include expansion cones 270, which are situated downhole from the pistons 200, 210. As illustrated in FIG. 1C, the expansion cones 270 have an outer diameter greater than an inner diameter of a section of the liner hanger 120 downhole from the expansion cones 270.

In an embodiment, the liner hanger 120 may be expanded against a wall of the casing after the liner has been cemented to the wall of the wellbore. To expand the liner hanger 120, a hydraulic fluid may be pumped down the work string and into the mandrels 110, 130, 140, 150, 190 at a pressure that may range from 2500 psi to 1000 psi. The hydraulic fluid may enter the pressure chambers 220, 230 via pressurization ports 240, 250 and exert a force on pistons 200, 210. In some contexts, the pistons 200, 210 may be said to develop motive force from a pressure differential between the interior of the mandrel and an exterior of the tool 100. The couplings 170, 180, which form uphole-side boundaries of the pressure chambers 220, 230, are rigidly attached to mandrels 130, 140 and 150, respectively, whereas pistons 200, 210 and expansion cones 270 are rigidly attached to a tool housing 280. In addition, the pistons 200, 210 and the expansion cones 270 may move longitudinally with respect to the mandrels 110, 130, 140, 150, 190. When a sufficient pressure has built up in the mandrels 110, 130, 140, 150, 190 and the pressure chambers 220, 230, the pistons 200, 210, along with the tool housing 280 and the expansion cones 270, are forced downhole with respect to the mandrels 110, 130, 140, 150, 190. Since the outer diameter of the expansion cones 270 is greater than the inner diameter of the liner hanger 120 and the liner hanger 120 is longitudinally fixed in position in the wellbore, a portion of the liner hanger 120 in contact with the expansion cones 270 is expanded against the casing as the expansion cones 270 are forced downhole.

Figure 1D:
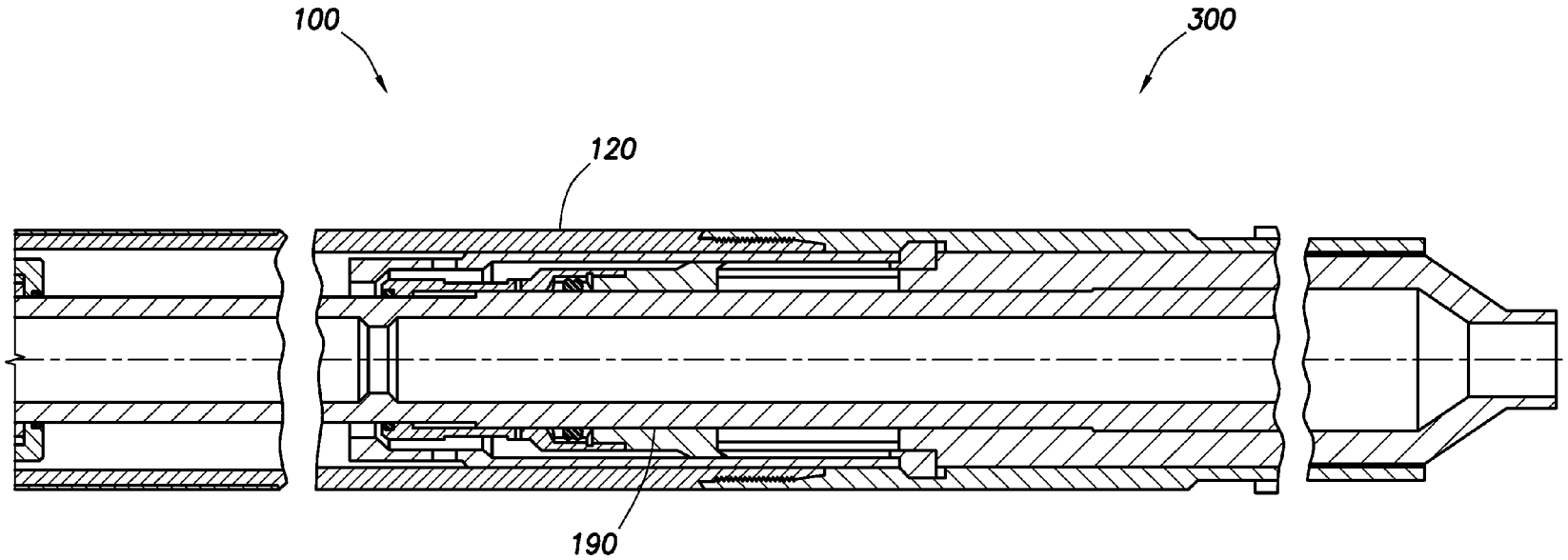
FIG. 1D is a schematic cross-sectional view of a further portion of the embodiment of a setting tool illustrated in FIG. 1A.

In regard to FIG. 1D, in an embodiment, the setting tool 100 may further comprise a valve mechanism 300, which is situated downhole from pistons 200, 210 and liner hanger 120 and is configured to close off a route of fluid communication between the collet mandrel 190 and an interior of the liner after the liner has been cemented to the wall of the wellbore. Various embodiments of the valve mechanism 300 will be described below in the discussion of FIG. 2, FIG. 4A, FIG. 4B, FIG. 4C, FIG. 5, FIG. 6A, FIG. 6B, FIG. 7A, FIG. 7B, FIG. 8A and FIG. 8B.

Figure 2:
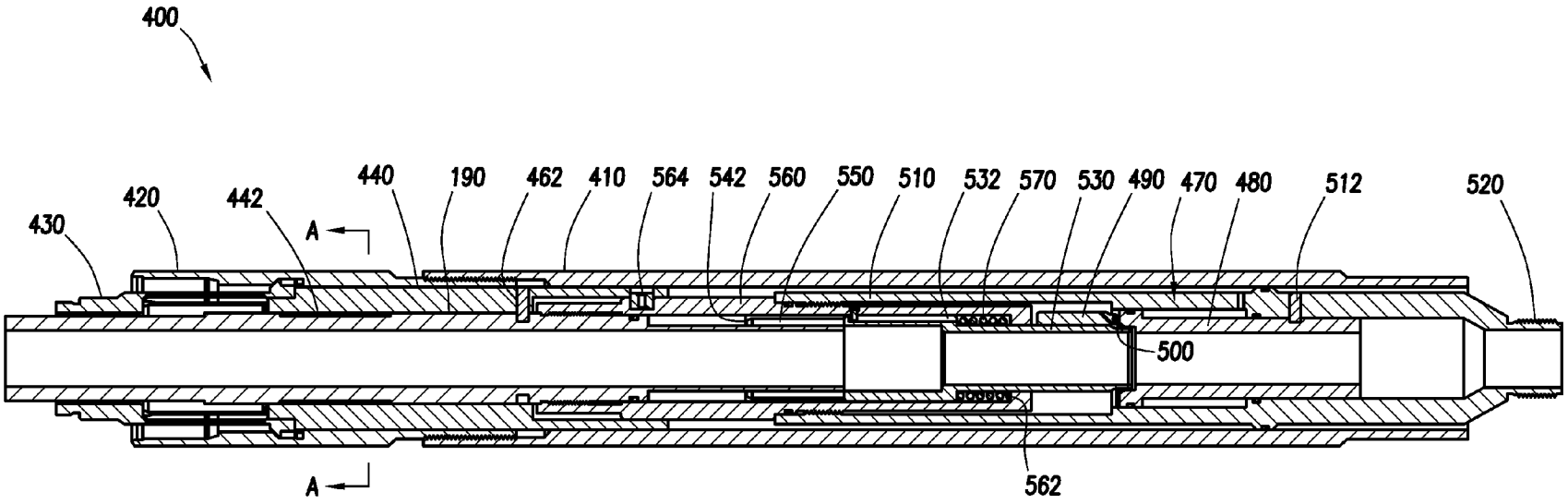
FIG. 2 is a schematic cross-sectional view of an embodiment of a valve mechanism.
Figure 3B:
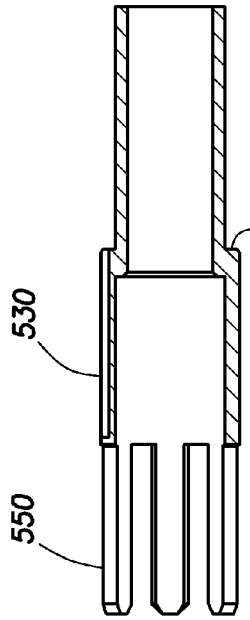
FIG. 3B is a schematic cross-sectional view of an embodiment of a flapper prop included in the valve mechanism of FIG. 2.

FIG. 2 is a schematic cross-sectional view of an embodiment of a valve mechanism 400. The valve mechanism 400 may comprise a housing 410, which is rigidly attached to the liner at a downhole end of the housing 410. The valve mechanism 400 also may comprise a setting sleeve 420, which is situated uphole from the housing 410 and rigidly attached to the housing 410 at an uphole end of the housing 410, and to which the liner hanger 120 is rigidly attached at an uphole end of the setting sleeve 420. In an embodiment, the valve mechanism 400 may further comprise a collet 430, which is situated at an uphole end of the valve mechanism 400 and is torsionally locked to the setting sleeve 420, as well as a collet prop 440, which is torsionally locked to the collet 430 and comprises collet prop teeth 450 that run longitudinally along a portion of a length of the collet prop 440 and are spaced along an inner circumference of the collet prop 440. The collet prop teeth 450 are clearly seen in the schematic cross-sectional view of the collet prop 440 shown in FIG. 3C.

Figure 3A:
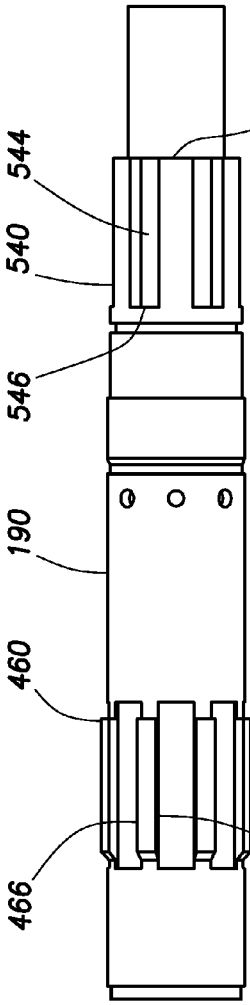
FIG. 3A is a schematic front view of an embodiment of a collet mandrel included in the valve mechanism of FIG. 2.
Figure 3D:
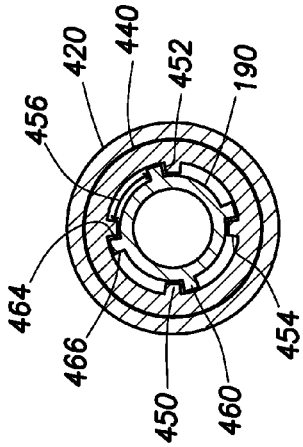
FIG. 3D is a schematic cross-sectional view of the embodiment of the valve mechanism of FIG. 2
Figure 3C:
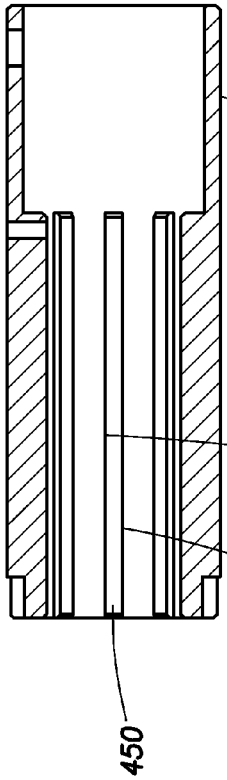
FIG. 3C is a schematic cross-sectional view of an embodiment of a collet prop included in the valve mechanism of FIG. 2.

In further regard to FIG. 2, a schematic front view of the collet mandrel 190 is shown in FIG. 3A. The collet mandrel 190 is rotatably disposed in the setting sleeve 420 and the housing 410. In addition, a portion of the collet mandrel 190 is situated in a through-bore 442 of the collet prop 440. In an embodiment, the collet mandrel 190 comprises collet mandrel teeth 460, which are situated near an uphole end of the collet mandrel 190, run longitudinally along a portion of a length of the collet mandrel 190 and are spaced along an outer circumference of the collet mandrel 190. In addition, the collet mandrel 190 may comprise second collet mandrel teeth 540, which are situated near a downhole end of the collet mandrel 190, run longitudinally along a portion of the length of the collet mandrel 190 and are spaced along the outer circumference of the collet mandrel 190. In an embodiment, the collet mandrel teeth 460 engage with the collet prop teeth 450 such that an angular slack 456 is present between the teeth 450, 460. The angular slack 456 may be about 20 degrees to about 40 degrees, alternatively about 25 degrees to about 35 degrees, alternatively about 30 degrees. The angular slack 456 is shown clearly in FIG. 3D.

Figure 4A:
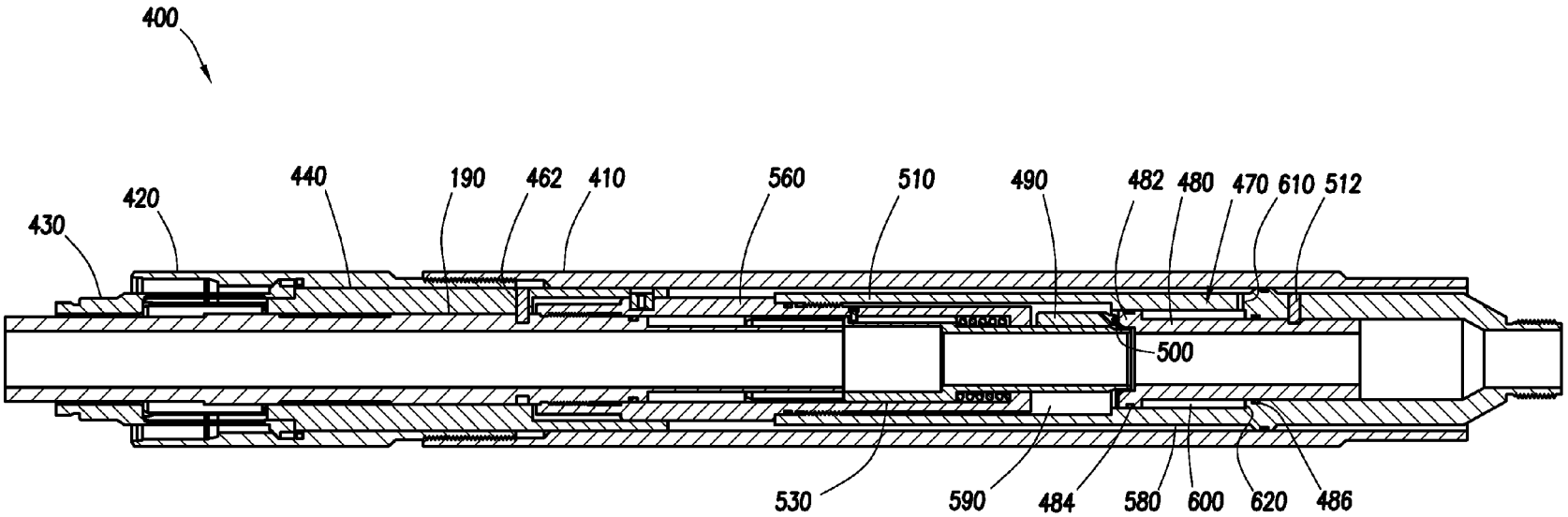
FIG. 4A is a schematic cross-sectional view of the embodiment of the valve mechanism of FIG. 2, prior to release of a flapper.

In addition to interaction of the collet mandrel 190 and the collet prop 440 via the collet prop teeth 450 and the collet mandrel teeth 460, the collet mandrel 190 and the collet prop 440 may be torsionally locked to one another by a shear screw 462 in the run-in state of the tool 100. Shear screw 462 is shown in FIG. 4A. In an embodiment illustrated in FIG. 3D, which shows a schematic cross-sectional view of valve mechanism 400 at section A-A in FIG. 2, the collet mandrel teeth 460 and the collet prop teeth 450 may be in engagement and the shear screw 462 may be placed such that, in a first rotational position of the collet mandrel 190 and a first rotational direction of the collet mandrel 190, e.g., clockwise or right-hand rotation (using a downhole direction as a frame of reference), side faces 464 of the collet mandrel teeth 460 facing, e.g., in a clockwise or right-hand direction, abut corresponding side faces 452 of the collet prop teeth 450 facing, e.g., in a counterclockwise or left-hand direction, and the collet mandrel 190 and the collet prop 440 are torsionally locked to one another by both their corresponding teeth 460, 450 and the shear screw 462 in a run-in state of the tool 100. In the same embodiment, in the first rotational position, but in a second rotational direction of the collet mandrel 190, e.g., counterclockwise or left-hand rotation, side faces 466 of the collet mandrel teeth 460 facing, e.g., in a counterclockwise or left-hand direction, are separated from side faces 454 of the collet prop teeth 450 facing, e.g., in a clockwise or right-hand direction, by the angular slack 456, such that the collet mandrel 190 and collet prop 440 are torsionally locked to one another by the shear screw 462 in the run-in state of the tool 100. In addition, it should be pointed out that for the sake of clarity, in FIG. 3D, the collet prop 440 and collet mandrel 190 are each shown as having only four teeth 450, 460. However, the collet prop 440 and collet mandrel 190 may have as many teeth as allowed by structural considerations and desired angular slack 456. Furthermore, the orientation of the collet prop teeth 450 and collet mandrel teeth 460 may be reversed so that the side faces 464 of the collet mandrel teeth 460 facing, e.g., in a clockwise or right-hand direction are separated from the side faces 452 of the collet prop teeth 450 facing, e.g., in a counterclockwise or left-hand direction, by the slack 456.

In an embodiment, the valve mechanism 400 may further comprise a flapper valve 470, which comprises a flapper piston 480, a flapper 490 pivoted at an uphole end of the flapper piston 480 and a flapper spring 500 that applies a closing force to the flapper 490. The flapper piston 480 may be situated in a flow bore of a flapper housing 510 and fixed in position with respect to the flapper housing 510 by a shear screw 512. In addition, the flapper housing 510 may include a subsurface release (SSR) cementing plug system connection 520 at a downhole end of the flapper housing 510.

In further regard to FIG. 2, in an embodiment, the valve mechanism 400 may further comprise a member 530, e.g., a flapper prop 530, which is configured to prop the flapper 490 open in a first longitudinal position of the flapper prop 530. The flapper prop 530 may comprise flapper prop teeth 550, which are situated at an uphole end of the flapper prop 530 and, in the first rotational position of the collet mandrel 190, engage with downhole end faces 542 of the second collet mandrel teeth 540. A schematic cross-sectional view of the flapper prop 530 is shown in FIG. 3B.

In an embodiment, the valve mechanism 400 may further comprise a spring housing 560, which is generally cylindrical in shape and torsionally locked to the collet prop 440 by a torque pin 564, and inside which a portion of the flapper prop 530 not in engagement with the flapper 490 is situated. As is apparent from FIGS. 2, 3*a* and 3*b*, a spring 570, which is biased between a shoulder 532 of the flapper prop 530 and an inwardly projecting flange 562 at a downhole end of the spring housing 560, forces flapper prop teeth 550 against the downhole end faces 542 of the second collet mandrel teeth 540, when the collet mandrel 190 is in the first rotational position.

In operation, after the liner has been cemented in the wellbore, the flapper 490 may be closed in order to allow sufficient pressure to be built up uphole from the flapper valve 470, to energize pistons 200, 210, and thereby to expand the liner hanger 120. In the embodiment of the valve mechanism 400 shown in FIG. 2, the flapper 490 may be released either hydraulically or mechanically. The hydraulic-release embodiment is discussed below in reference to FIG. 4A and FIG. 4B, and the mechanical-release embodiment is discussed below in reference to FIG. 3, FIG. 4A and FIG. 4C.

Figure 4B:
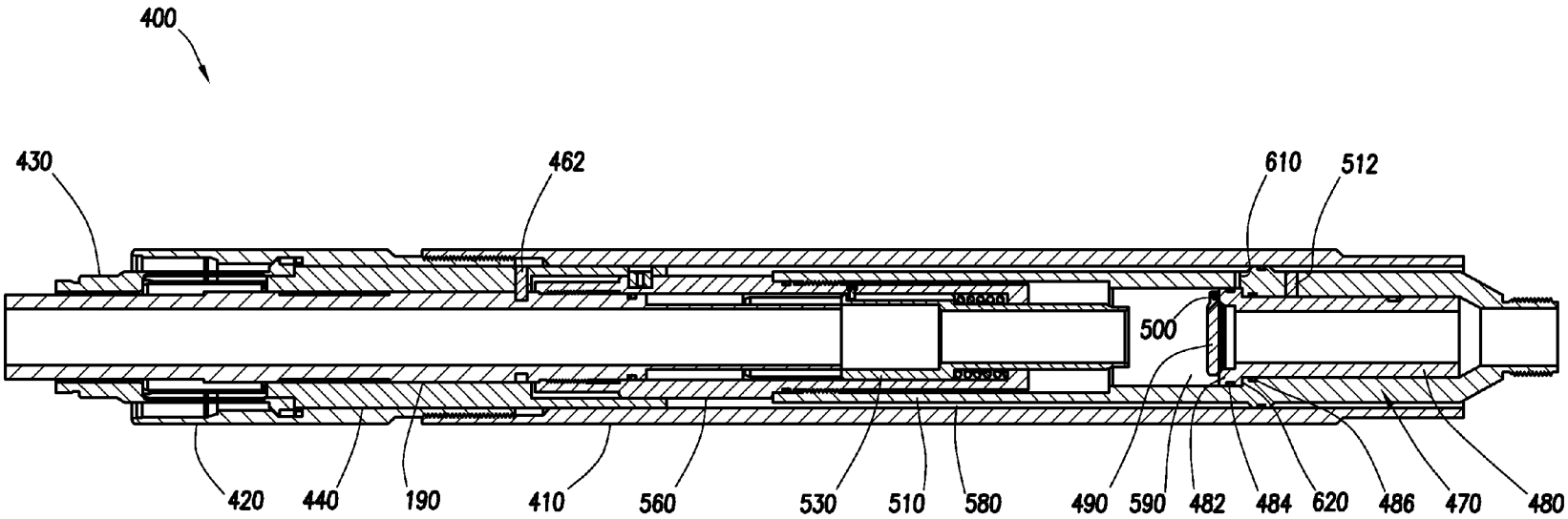
FIG. 4B is a schematic cross-sectional view of the embodiment of the flapper mechanism of FIG. 2, after hydraulic release of the flapper.

FIG. 4A and FIG. 4B respectively illustrate schematic cross-sectional views of the embodiment of the valve mechanism 400 of FIG. 2, prior to release of the flapper 490 and after hydraulic release of the flapper 490. To release the flapper 490 hydraulically, a fluid may be pumped down the mandrels 130, 140, 150, 190 at a second pressure greater than a first pressure prevailing in an annulus 580 situated between the flapper housing 510 and the housing 410. Since an area of contact of a downhole end of the flapper prop 530 and a flapper piston head 482 is not sealed, an annular space 590 uphole from the flapper piston head 482 and roughly bounded by the flapper piston head 482, the flapper housing 510 and the spring housing 560 is subjected to the second pressure in the mandrels 130, 140, 150, 190.

In addition, a second annular space 600 situated below the flapper piston head 482 and bounded by the flapper piston 480 and the flapper housing 510 is in fluid communication with annulus 580 via a vent hole 610 and is therefore subjected to the first pressure. When a pressure differential of the second and first pressures is sufficient to overcome a shear strength of the shear screw 512, a force of friction of an O-ring 484 disposed between the flapper piston head 482 and the flapper housing 510, and a force of friction of an O-ring 486 disposed between the flapper housing 510 and the flapper piston 480, the shear screw 512 may shear and the flapper piston 480 may be forced down the flow bore of the flapper housing 510 to a limit stop 620 situated on the flapper housing 510. As shown in FIG. 4B, when the flapper piston head 482 approaches the limit stop 620, the flapper 490 is moved clear of the flapper prop 530, and the flapper spring 500 forces the flapper 490 into a closed position.

Figure 4C:
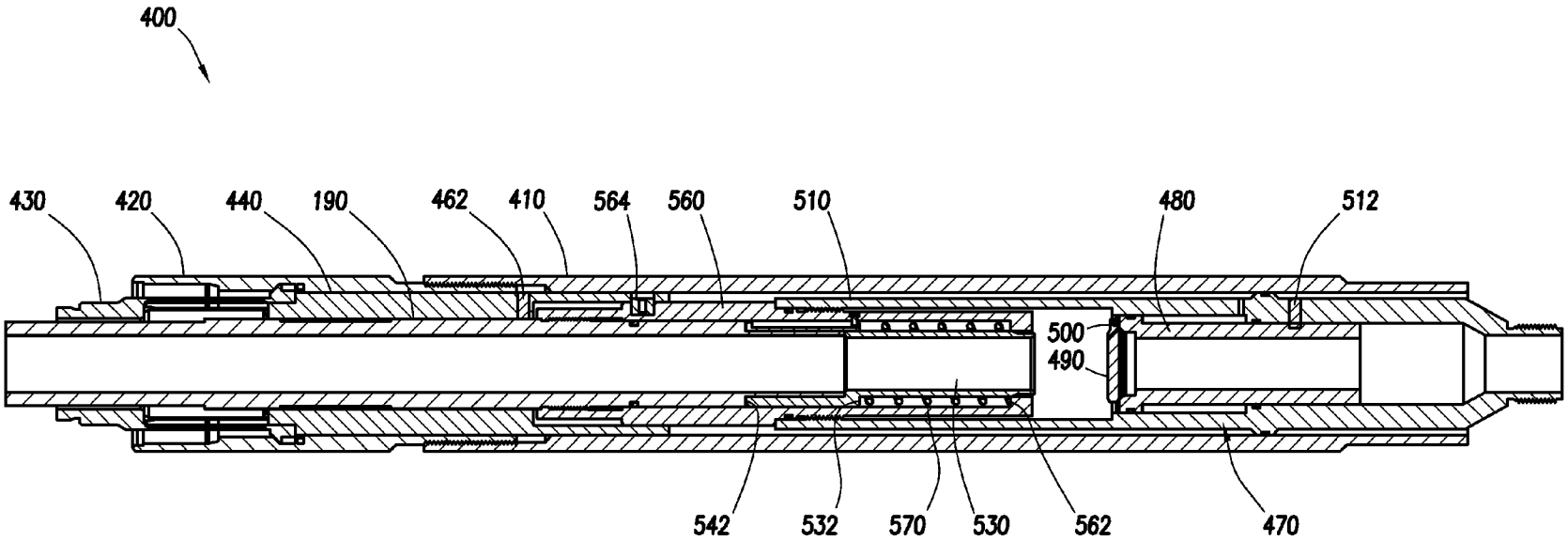
FIG. 4C is a schematic cross-sectional view of the embodiment of the flapper mechanism of FIG. 2, after mechanical release of the flapper.

FIG. 4A and FIG. 4C respectively illustrate schematic cross-sectional views of the embodiment of the valve mechanism 400 of FIG. 2 before release of the flapper 490 and after mechanical release of the flapper 490. As set forth above and illustrated in FIG. 2 and FIG. 3D, in the first rotational position of the collet mandrel 190 and the first rotational direction of the collet mandrel 190, e.g., clockwise or right-hand rotation, the collet mandrel 190 is torsionally locked to the collet prop 440 by the collet prop teeth 450, the collet mandrel teeth 460 and the shear screw 462. In addition, in the first rotational position of the collet mandrel 190, the flapper prop 530 props the flapper 490 open, and the flapper prop teeth 550 rest against downhole end faces 542 of the second collet mandrel teeth 540 under the force of the spring 570 biased between the flange 562 of the spring housing 560 and the shoulder 532 of the flapper prop 530.

However, in the first rotational position of the collet mandrel 190 and the second rotational direction of the collet mandrel 190, e.g., counterclockwise or left-hand rotation, the collet prop 440 and the collet mandrel 190 are torsionally locked to one another by the shear screw 462 in the run-in state of the tool 100. Thus, in an embodiment, if a left-hand torque sufficient to overcome a shear strength of the shear screw 462 is applied to the collet mandrel 190, the shear screw 462 will shear and the collet mandrel 190 will rotate through the slack 456 and into a second rotational position of the collet mandrel 190, where the side faces 466 of the collet mandrel teeth 460 abut the side faces 454 of the collet prop teeth 450. Furthermore, as the collet mandrel 190 is rotated from the first rotational position into the second rotational position, the downhole end faces 542 of the second collet mandrel teeth 540 rotate out of alignment with the flapper prop teeth 550 and into a position in which the flapper prop teeth 550 are aligned with gaps 544 between the second collet mandrel teeth 540 that are wider than the flapper prop teeth 550. Gaps 544 and contact ends 546 are illustrated in FIG. 3A. Thus, since the second collet mandrel teeth 540 are no longer able to apply a reaction force against the spring 570, the spring 570 forces the flapper prop 530 uphole until the flapper prop teeth 550 contact ends 546 of the gaps 544. As the flapper prop teeth 550 slide through the gaps 544 to the ends of the gaps 546, the downhole end of the flapper prop 530 moves uphole and free of the flapper 490, thereby allowing the flapper spring 500 to close the flapper 490.

Figure 5:
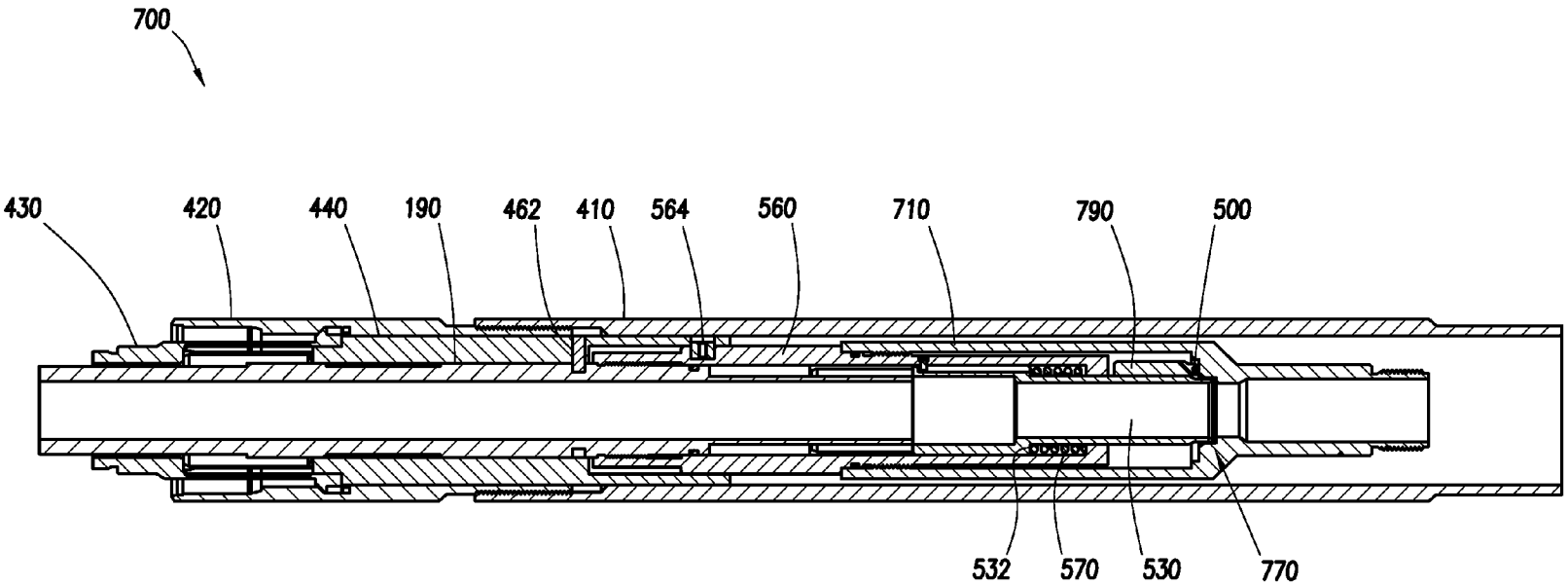
FIG. 5 is a schematic cross-sectional view of a further embodiment of a valve mechanism.

FIG. 5 is a schematic cross-sectional view of a further embodiment of a valve mechanism. A valve mechanism 700 shown in FIG. 5 differs from the embodiment of the valve mechanism 400 shown in FIG. 2 and FIG. 4A, FIG. 4B, and FIG. 4C in that a flapper valve 770 comprised by valve mechanism 700 does not comprise a flapper piston, and a flapper 790 comprised by the valve mechanism 700 is mounted directly to a flapper housing 710. In addition, since no portion of a length of the flapper housing 710 is reserved for downhole displacement of a flapper piston, the length of the flapper housing 710 may be less than a length of the flapper housing 510. Furthermore, the flapper 790 may be mechanically released in a manner analogous to flapper 490, by shearing shear screw 462; rotating collet mandrel 190 with respect to collet prop 440 so as to align flapper prop teeth 550 with gaps 544 between second collet mandrel teeth 540; and displacing flapper prop 530 uphole via spring 570 so that the downhole end of flapper prop 530 clears the flapper 790 and the flapper spring 500 closes the flapper 790.

Figure 6A:
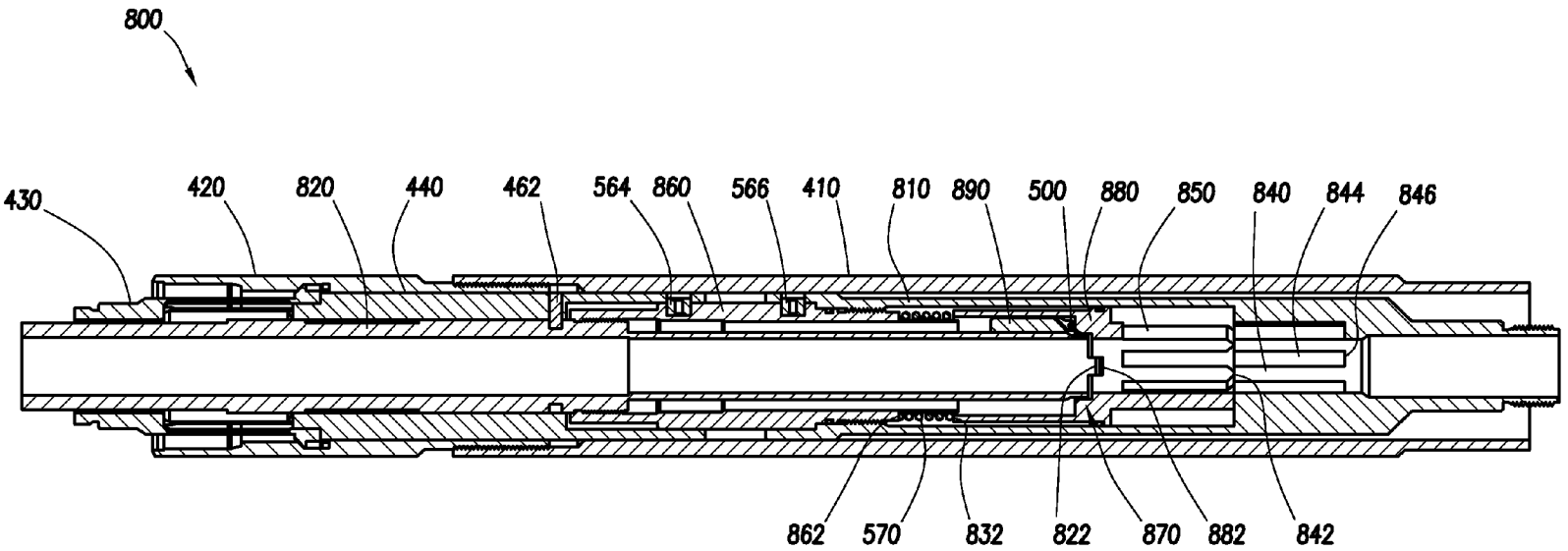
FIG. 6A is a schematic cross-sectional view of a further embodiment of a valve mechanism.
Figure 6B:
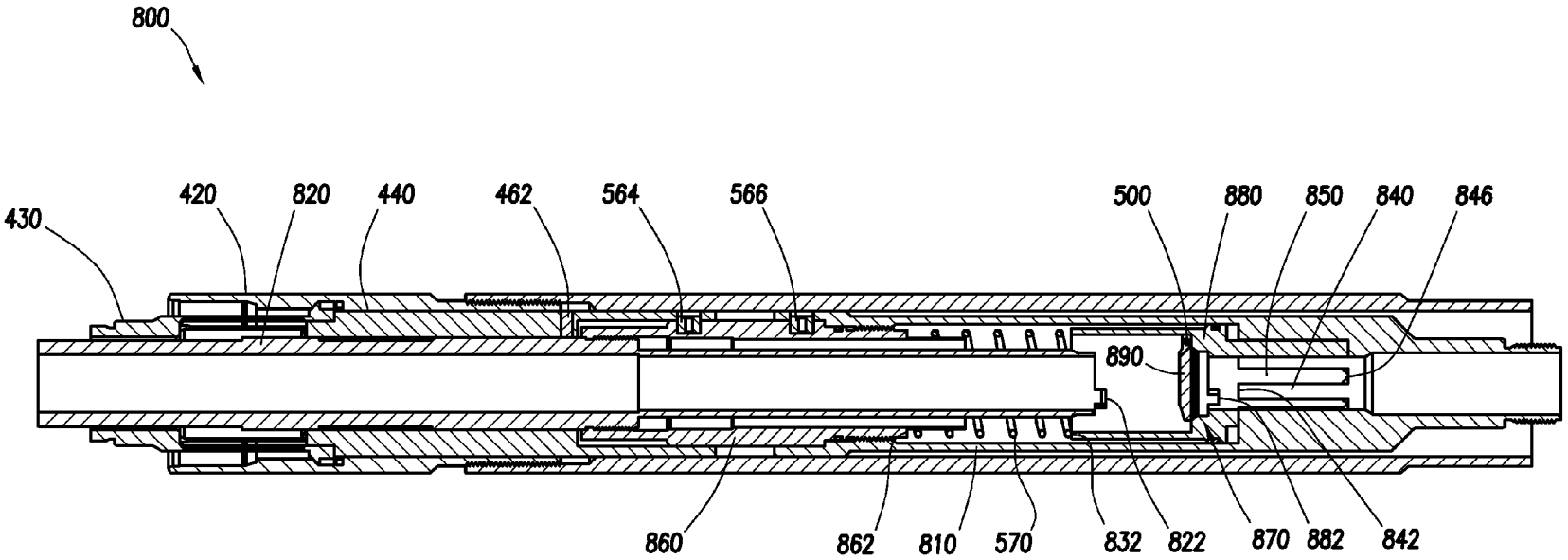
FIG. 6B is a schematic cross-sectional view of the embodiment of the valve mechanism of FIG. 6A, after mechanical release of a flapper.

FIG. 6A and FIG. 6B schematically illustrate cross-sectional views of a further embodiment of a valve mechanism 800 prior to and after mechanical release of a flapper 890, respectively. The embodiment of the valve mechanism 800 of FIG. 6A and FIG. 6B differs from the embodiment of the valve mechanism 400 of FIG. 2 in that a different member, e.g., a collet mandrel 820, props a flapper 890 open, and a flapper piston 880 includes flapper piston teeth 850 that engage with flapper housing teeth 840 present on a flapper housing 810. In some contexts the flapper piston 880 may be referred to as a flapper seat. This structure is referred to herein as a flapper piston 880 to suggest its response to a pressure differential and the role of this response in deployment and/or actuation of the flapper 890, but it is understood that those skilled in the art may sometimes refer to it instead as a flapper seat. In an embodiment, the collet mandrel 820 extends through the collet prop 440 and a spring housing 860 to a flapper valve 870, which comprises the flapper piston 880 and the flapper 890, which, in turn, is spring-mounted to the flapper piston 880. In a first rotational position of the collet mandrel 820, a lug 822 situated at a downhole end of the collet mandrel 820 engages with a corresponding notch 882 in the flapper piston 880 and torsionally locks the flapper piston 880 to the collet mandrel 820. In an embodiment, the spring 570 is biased between an uphole end 832 of the flapper piston 880 and a shoulder 862 of a spring housing 860, which is torsionally locked to collet prop 440 by torque pin 564 and torsionally locked to flapper housing 810 by a torque pin 566. In the first rotational position of the collet mandrel 820, the flapper piston teeth 850 engage with uphole end faces 842 of the flapper housing teeth 840 and are pressed against the uphole end faces 842 by a force of the spring 570.

In operation, the flapper 890 of the present embodiment of the valve mechanism 800 may be released via rotation of the collet mandrel 820 and rotation and translation of the flapper piston 880 as follows. The collet mandrel teeth 460 of collet mandrel 820 and the collet prop teeth 450 of collet prop 440 interact as described with respect to FIG. 2 and FIG. 3D such that when, for example, a left-hand or counterclockwise torque is applied to the collet mandrel 820, the shear screw 462 may be sheared and the collet mandrel 820 may be rotated through slack 456 from the first rotational position to a second rotational position. As the collet mandrel 820 is rotated from the first rotational position to the second rotational position, the flapper piston teeth 850 are rotated out of engagement with uphole end faces 842 of the flapper housing teeth 840 and into alignment with gaps 844, which are situated between adjacent flapper housing teeth 840 and are wider than flapper piston teeth 850. Since in the second rotational position of the collet mandrel 820, the flapper housing teeth 840 can no longer apply a reaction force to the flapper piston teeth 850 in opposition to the force of the spring 570, the flapper piston 880 is forced downhole by the spring 570 such that the flapper piston teeth 850 slide into the gaps 844 between the flapper housing teeth 840 until coming to rest against ends 846 of the gaps 844. In addition, as the flapper piston 880 is moved downhole, the flapper 890 is moved free of the collet mandrel 820, thereby enabling the flapper spring 500 to force the flapper 890 into a closed position.

Figure 7A:
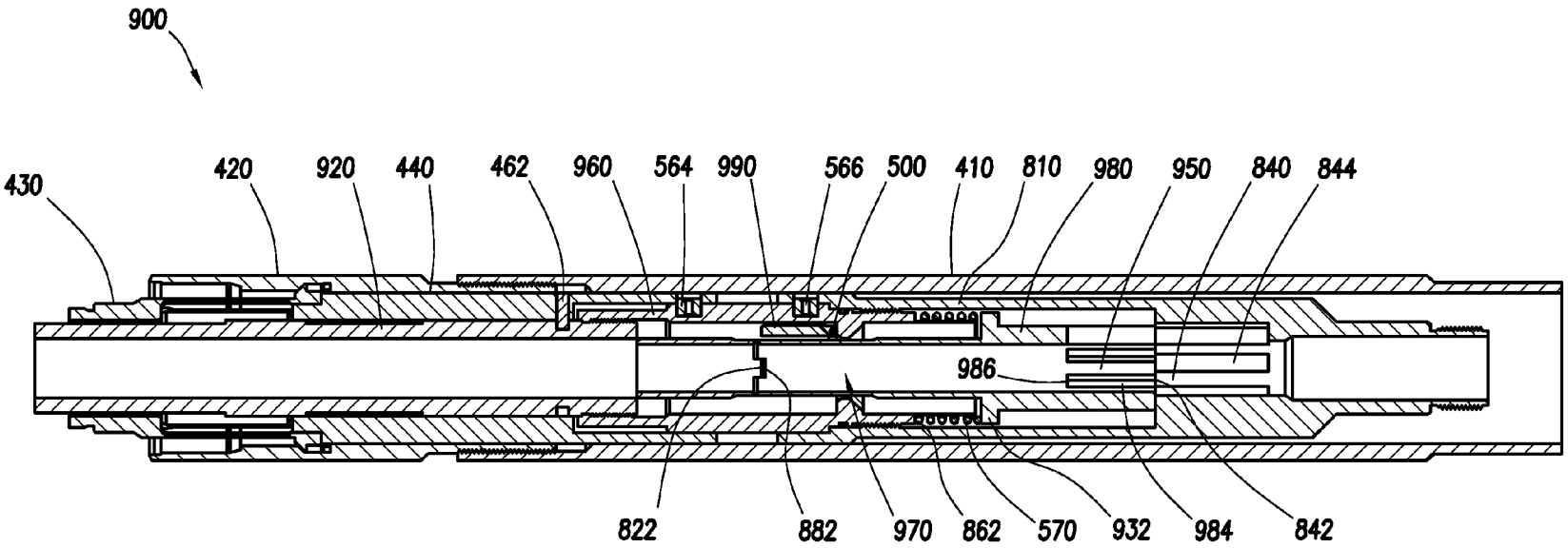
FIG. 7A is a schematic cross-sectional view of a further embodiment of a valve mechanism.
Figure 7B:
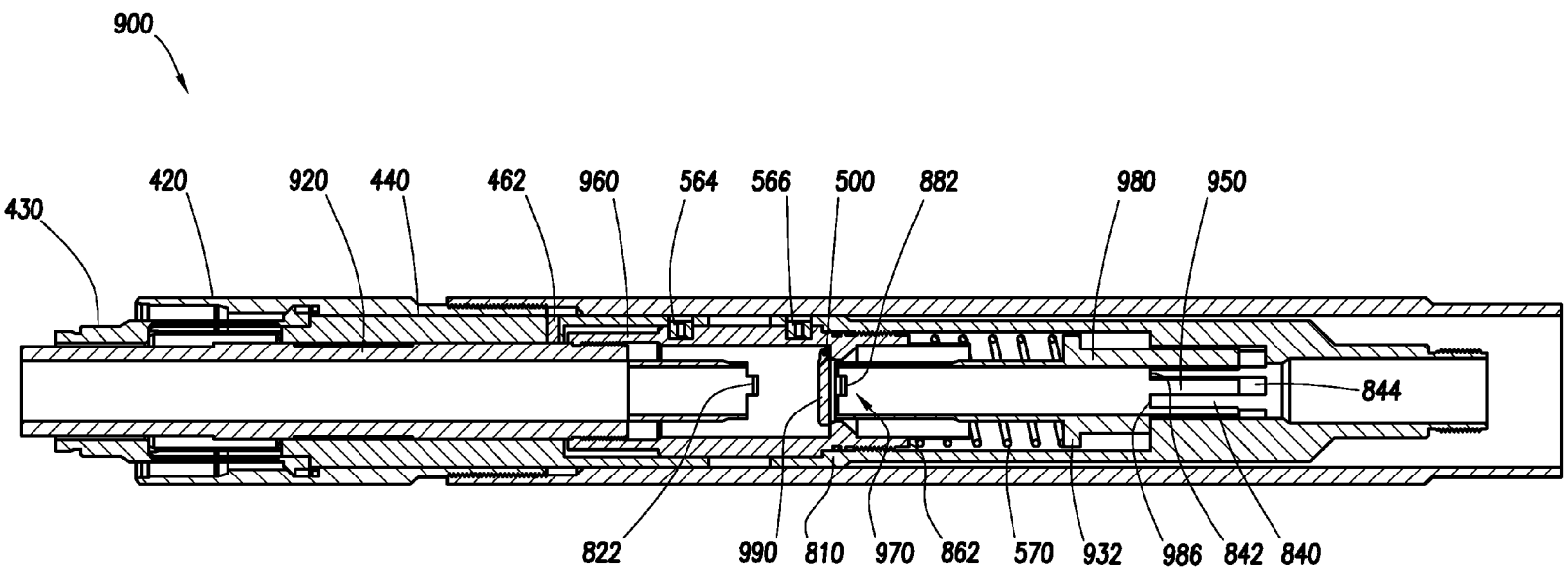
FIG. 7B is a schematic cross-sectional view of the embodiment of the valve mechanism of FIG. 7A, after mechanical release of a flapper.

FIG. 7A and FIG. 7B respectively illustrate schematic cross-sectional views of a further embodiment of a valve mechanism 900 prior to and after mechanical release of a flapper 990. The valve mechanism 900 differs from the valve mechanism 800 illustrated in FIG. 6A and FIG. 6B in that in a flapper valve 970 comprising the flapper 990 and a flapper piston 980, a different member, e.g., the flapper piston 980, props the flapper 990 open and is moved downhole to release the flapper 990. In addition, the flapper 990 is spring-mounted to a spring housing 960. In an embodiment, a collet mandrel 920 extends through the collet prop 440 to the flapper piston 980, and, in a first rotational position of the collet mandrel 920, the collet mandrel 920 is torsionally locked to the flapper piston 980 by the lug 822, which engages with the notch 882 in the flapper piston 980. In an embodiment, the spring 570 is biased between the shoulder 862 of the spring housing 960 and a flange 932 of the flapper piston 980. In the first rotational position of the collet mandrel 920, flapper piston teeth 950 of the flapper piston 980 engage with the uphole end faces 842 of the flapper housing teeth 840 and are pressed against the uphole end faces 842 by a force of the spring 570.

In operation, the flapper 990 of the present embodiment of the valve mechanism 900 may be released via rotation of the collet mandrel 920 and rotation and translation of the flapper piston 980 as follows. The collet mandrel teeth 460 of collet mandrel 920 and the collet prop teeth 450 of collet prop 440 interact as described with respect to FIG. 2 and FIG. 3D such that when, for example, a left-hand or counterclockwise torque is applied to the collet mandrel 920, the shear screw 462 may be sheared and the collet mandrel 920 may be rotated through slack 456 from the first rotational position to a second rotational position. As the collet mandrel 920 is rotated from the first rotational position to the second rotational position, the flapper piston teeth 950 are rotated out of engagement with the uphole end faces 842 of the flapper housing teeth 840 and into alignment with gaps 844, which are situated between adjacent flapper housing teeth 840 and are wider than flapper piston teeth 950. Since in the second rotational position of the collet mandrel 920, the flapper housing teeth 840 can no longer apply a reaction force to the flapper piston teeth 950 in opposition to the force of the spring 570, the flapper piston 980 is forced downhole by the spring 570, such that the flapper piston teeth 950 slide into the gaps 844 between the flapper housing teeth 840. Simultaneously, the flapper housing teeth 840 enter gaps 984 between the flapper piston teeth 950 until the flapper piston 980 comes to rest with the uphole end faces 842 of the flapper housing teeth 840 abutting ends 986 of the gaps 984. As the flapper piston teeth 950 slide into the gaps 844 between the flapper housing teeth 840, an uphole end of the flapper piston 980 slides free of the flapper 990, thereby enabling the flapper spring 500 to force the flapper 990 into a closed position.

Figure 8A:
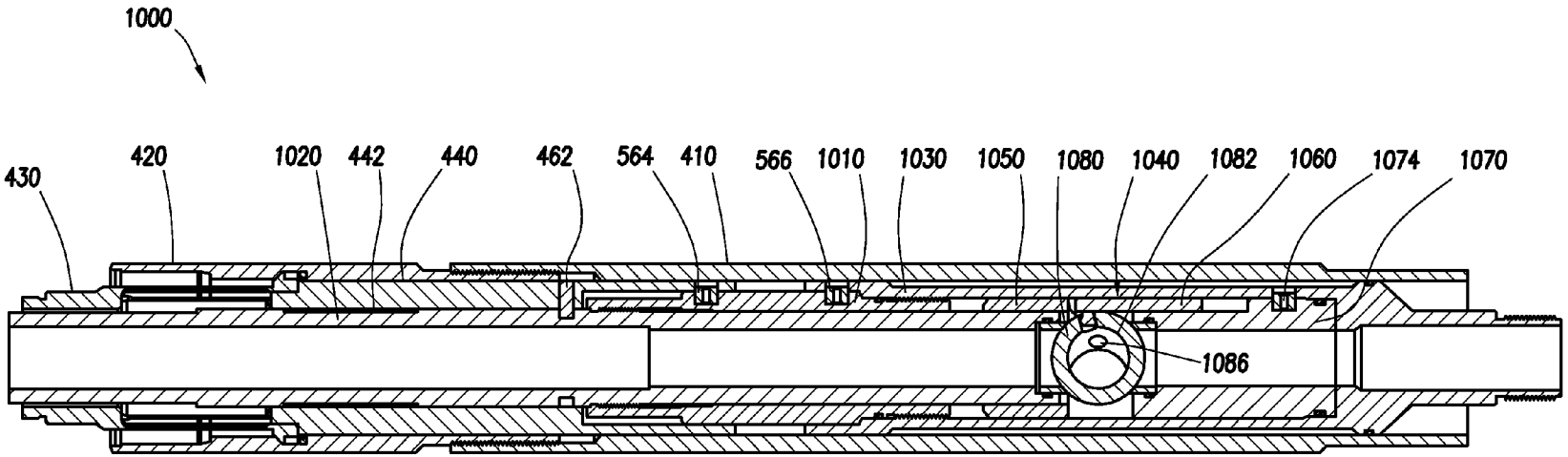
FIG. 8A is a schematic cross-sectional view of a further embodiment of a valve mechanism, in which a ball valve is closed.
Figure 8B:
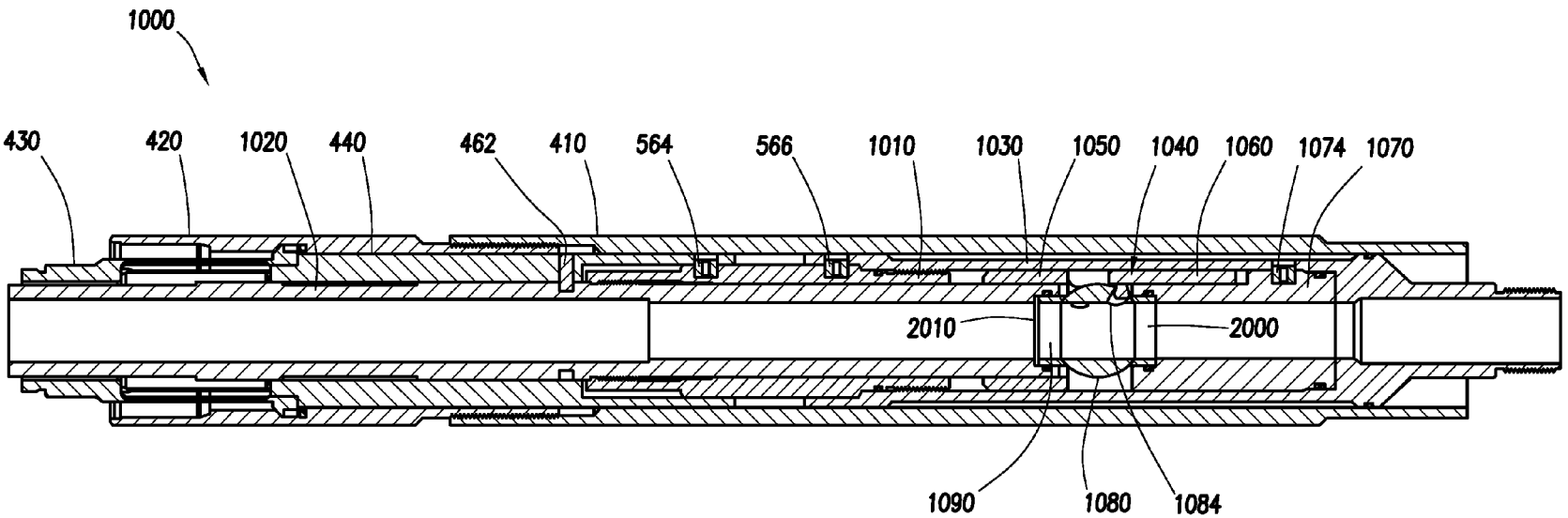
FIG. 8B is a schematic cross-sectional view of the embodiment of the valve mechanism of FIG. 8A, in which the ball valve is open.
Figure 8C:
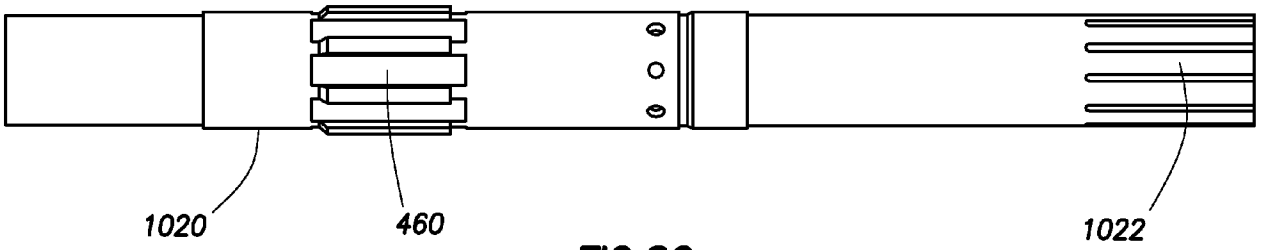
FIG. 8C is a schematic front view of an embodiment of a collet mandrel included in the valve mechanism of FIG. 8A.

FIG. 8A and FIG. 8B illustrate schematic cross-sectional views of an embodiment of a valve mechanism 1000 comprising a ball valve 1040, FIG. 8A illustrating the ball valve 1040 in a closed position and FIG. 8B illustrating the ball valve 1040 in an open position. The embodiment of the valve mechanism 1000 shown in FIGS. 8*a* and 8*b* differs from the embodiments of the valve mechanisms 400, 700, 800 and 900 in that the ball valve 1040 is used in place of a flapper valve to close off a route of fluid communication between a collet mandrel 1020 of the valve mechanism 1000 and an interior of the liner after the liner has been cemented to the wall of the wellbore; the spring housing 560, 860, 960 is replaced by a coupling 1010 that is torsionally locked to the collet prop 440; and the flapper housing 510, 710, 810 is replaced by a ball housing 1030, which is torsionally locked to the coupling 1010 by the torque pin 566, and inside which the ball valve 1040 is situated. However, as is the case with the embodiments of the valve mechanism 400, 700, 800 and 900, the collet mandrel 1020, of which a schematic side view is shown in FIG. 8C, is rotatably disposed in the setting sleeve 420 and the housing 410, comprises collet mandrel teeth 460 that engage with the collet prop teeth 450 of the collet prop 440 as described with regard to FIG. 2, and is torsionally locked to the collet prop 440 by shear screw 462 in the run-in state of the tool 100.

In an embodiment, the ball valve 1040 may comprise a ball 1080, inside which a flow bore 1082 is situated, and which is supported by an upper seat 1090 and a lower seat 2000. The ball valve 1040 may also comprise a slider sleeve 1070, of which a schematic perspective view is shown in FIG. 8F, and which is torsionally locked to the ball housing 1030 by a torque pin 1074. The ball valve 1040 may further comprise an actuator collar 1050, of which a schematic side view is shown in FIG. 8D, and which comprises actuator collar teeth 1054 that engage with second collet mandrel teeth 1022 of the collet mandrel 1020 and torsionally lock the actuator collar 1050 to the collet mandrel 1020.

In an embodiment, the upper seat 1090 may be situated in a depression in a downhole end of the collet mandrel 1020, and the lower seat 2000 may be situated in a depression in an uphole end of the slider sleeve 1070, so that the ball 1080 and seats 1090, 2000 are supported between the collet mandrel 1020 and the slider sleeve 1070. In addition, the ball 1080 may be prestressed in the upper and lower seats 1090, 2000 by a spring, e.g., a wave spring 2010, which is situated between the upper seat 1090 and the collet mandrel 1020.

Figure 8E:
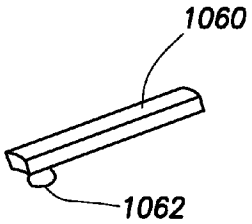
FIG. 8E is a schematic perspective view of an embodiment of a slider pin included in the valve mechanism of FIG. 8A.
Figure 8D:
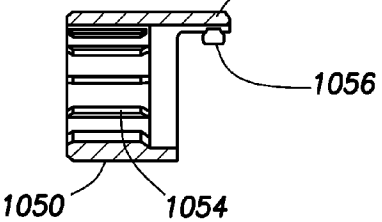
FIG. 8D is a schematic front view of an embodiment of an actuator collar included in the valve mechanism of FIG. 8A.
Figure 8F:
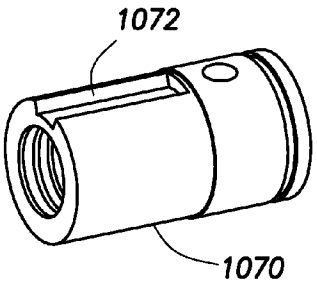
FIG. 8F is a schematic perspective view of an embodiment of a slider sleeve included in the valve mechanism of FIG. 8A.

In an embodiment, the ball valve 1040 may further comprise a slider pin 1060, of which a schematic perspective view is shown in FIG. 8E, which is slidably supported in a longitudinal groove 1072 situated at an outer circumference of the slider sleeve 1070, and which comprises a first projection 1062 that may be bulbous in shape and engages with a first surface bore 1084 of the ball 1080. In addition, the actuator collar 1050 may include an actuator pin 1052, which is rigidly attached to the actuator collar 1050, projects longitudinally from a downhole end of the actuator collar 1050, and includes a second projection 1056 that may be bulbous in shape and engages with a second surface bore 1086 of the ball 1080.

In an embodiment, the first projection 1062 and the first surface bore 1084 may form a first ball joint, and the second projection 1056 and the second surface bore 1086 may form a second ball joint, which, along with the upper seat 1090 and the lower seat 2000, constrain a movement of the ball 1080. Using a longitudinal axis of the valve mechanism 1000 as a "horizontal" axis, the upper and lower seats 1090, 2000 limit the movement of the ball 1080 to rolling motions about the longitudinal valve mechanism axis, as well as pitching and yawing motions about axes perpendicular to the longitudinal valve mechanism axis. In addition, the slider pin 1060 further constrains the movement of the ball 1080 to rotation about axes passing through the first projection 1062, as well as a pitching motion due to the capability of the slider pin 1060 of sliding longitudinally in the groove 1072 of the slider sleeve 1070. Furthermore, the actuator pin 1052 further constrains the movement of the ball 1080 to rotation about axes passing through the second projection 1056, as well as a rolling motion due to the capability of the actuator pin 1052 of orbiting the longitudinal valve mechanism axis.

In operation, in an embodiment, the ball valve 1040 of the valve mechanism 1000 may be closed via rotation of the collet mandrel 1020 and rotation of the ball 1080 as follows. The collet mandrel teeth 460 of collet mandrel 1020 and the collet prop teeth 450 of collet prop 440 interact as described with respect to FIG. 2 and FIG. 3D such that when, for example, a left-hand or counterclockwise torque is applied to the collet mandrel 1020, the shear screw 462 may be sheared and the collet mandrel 1020 may be rotated through slack 456, in a first rotational direction, from a first rotational position to a second rotational position. In the first rotational position of the collet mandrel 1020, the ball valve 1040 is open, i.e., the flow bore 1082 of the ball 1080 is in approximate alignment and fluid communication with flow bores of the collet mandrel 1020 and the slider sleeve 1070, as shown in FIG. 8B.

In an embodiment, as the collet mandrel 1020 is rotated from the first rotational position to the second rotational position, the actuator pin 1052 and the second projection 1056 are orbited about the longitudinal valve mechanism axis, thereby imparting a rolling motion to the ball 1080 and allowing the ball 1080 to rotate about axes passing through the second projection 1056. However, the slider pin 1060 simultaneously constrains the above-mentioned rolling motion while allowing the ball 1080 to undergo a pitching motion and rotation about axes passing through the first projection 1062. The above-mentioned constraints cause the ball 1080 to rotate into a closed position, in which the flow bore 1082 of the ball 1080 is no longer in fluid communication with the flow bores of the collet mandrel 1020 and the slider sleeve 1070 and a longitudinal axis of the flow bore 1082 is approximately perpendicular to the longitudinal valve mechanism axis. The above-mentioned closed position of the ball valve 1040 is shown in FIG. 8A.

In an embodiment, after having been closed, the ball valve 1040 may be reopened by rotating the collet mandrel 1020 in a second rotational direction, from the second rotational position to the first rotational position. The reopening capability of the ball valve 1040 may allow the route of fluid communication through the setting tool 100 to be reopened in case the ball valve 1040 is prematurely closed, and also may allow tools or fluids to pass through the setting tool 100 after expansion of the liner hanger 120.

Figure 9:
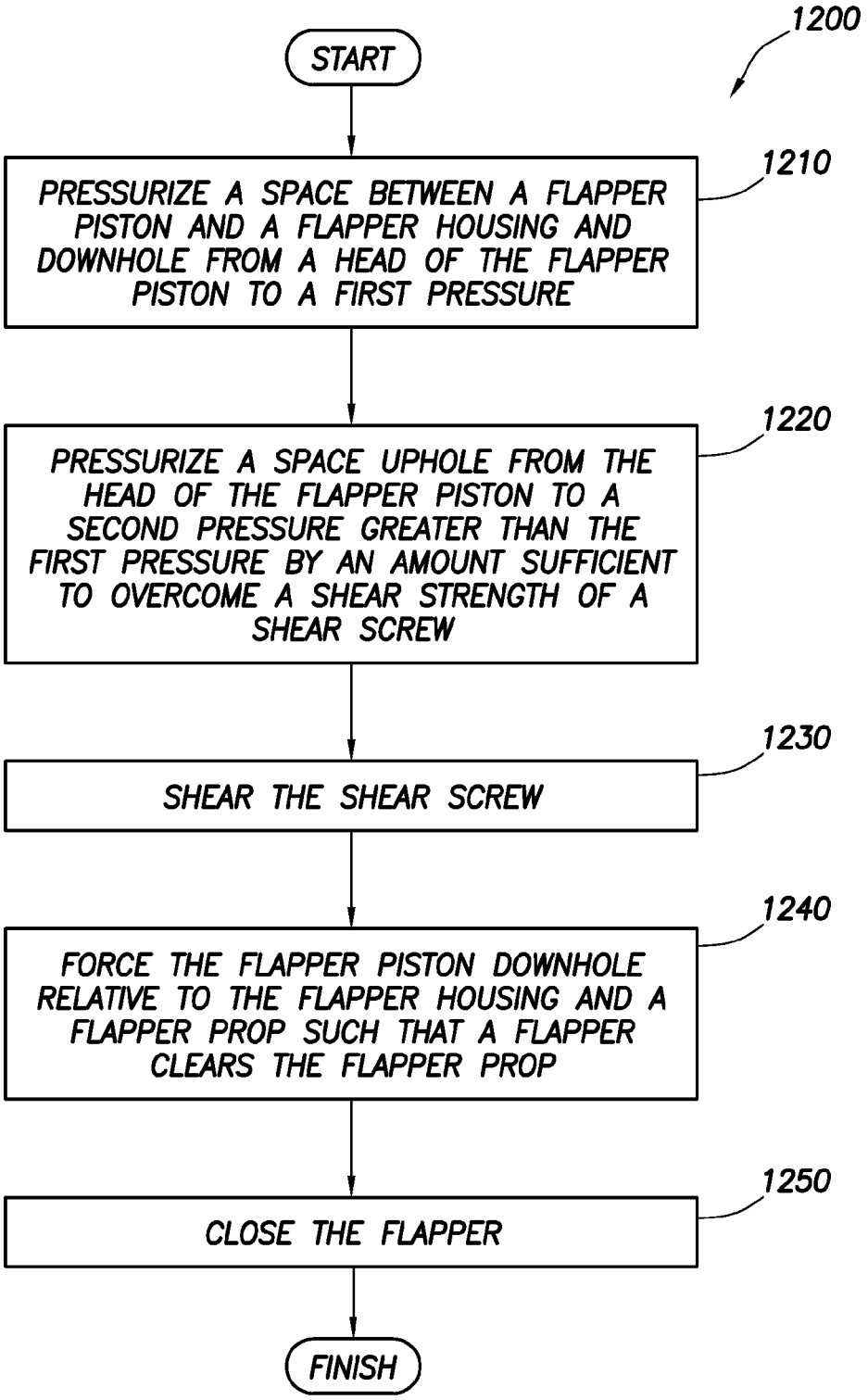
FIG. 9 is a flow chart of a method for hydraulically releasing a flapper valve.

FIG. 9 is a flow chart of a method 1200 for hydraulically releasing a flapper valve of a setting tool configured to set a liner hanger inside a casing. At block 1210, a space between a flapper piston and a flapper housing and downhole from a head of the flapper piston is pressurized to a first pressure. At block 1220, a space uphole from the head of the flapper piston is pressurized to a second pressure greater than the first pressure by an amount sufficient to overcome a shear strength of a shear screw. It is understood that the difference between the second pressure and the first pressure corresponds to the pressure differential across the flapper piston and hence the motive force for moving the flapper piston and shearing the shear screw. As illustrated in FIG. 2, the shear screw rigidly fixes the flapper piston to a flapper housing. At block 1230, the shear screw is sheared. At block 1240, the flapper piston is forced downhole relative to the flapper housing and a flapper prop such that a flapper clears the flapper prop. At block 1250, the flapper is closed.

In an embodiment, a method of setting an apparatus inside a wellbore is taught. The method may comprise using a downhole tool to set a liner in a casing, to set a packer in a casing or in an open hole, or to set some other apparatus inside a wellbore. The method may comprise actuating a valve to block downwards flow through the setting tool, for example, downwards flow of drilling fluid and/or hydraulic fluid. The method may further comprise developing a pressure differential between an interior of the setting tool above the valve and an exterior of the setting tool. For example, a greater pressure may be developed inside the setting tool and above the valve with reference to the hydrostatic pressure in the wellbore outside the setting tool by action of hydraulic pumps operated at a surface proximate to the wellbore. The method may further comprise setting a liner in the casing, setting a packer, or setting some other apparatus in the wellbore. The force for performing the setting may be derived from the pressure differential between the interior of the setting tool and the exterior of the setting tool. For example, in an embodiment, downwards force for setting may be developed by a piston responsive to the pressure differential, wherein the piston forms a part of the setting tool or a sub-assembly coupled to the setting tool. The piston is located above the valve.

In an embodiment, two or more pistons may be located above the valve and may form a portion of the setting tool or may form a portion of one or more sub-assemblies. Using two or more pistons may permit developing greater setting force than would otherwise be developed by a single piston. By coupling the two or more pistons, the force developed may be approximately the sum of the force developed by each individual piston. It is contemplated that the setting tool of this method may be substantially similar to the setting tool described above. The valve may be implemented by one of the multiple embodiments of flapper valves described further above. Alternative, the valve may be implemented by a ball valve as described further above.

While embodiments of the invention have been shown and described, modifications thereof can be made by one skilled in the art without departing from the spirit and teachings of the invention. For example, in an embodiment, the valve mechanism 400 shown in FIG. 2 may be modified to eliminate the spring 570 between the flapper prop 530 and the spring housing 560, to rigidly attach the flapper prop 530 to the collet mandrel 190, to attach a lug to the collet mandrel 190 or flapper prop 530, and to form a J-slot, e.g., a helical slot, in the spring housing 560 in which the lug is configured to travel. In this manner, the flapper 490 may be released by rotating the collet mandrel 190 and simultaneously translating the collet mandrel 190 and flapper prop 530 uphole, along the helical slot, and free of the flapper 490. Thus, the embodiments described herein are exemplary only, and are not intended to be limiting. Many variations and modifications of the invention disclosed herein are possible and are within the scope of the invention.

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention.

What we claim as our invention is:

1. A downhole oilfield tool assembly, comprising:

a mandrel comprising a collet mandrel, wherein the collet mandrel is rotatably disposed in the downhole oilfield tool assembly, and wherein the collet mandrel comprises collet mandrel teeth;

an actuator collar comprising actuator collar teeth, wherein the actuator collar teeth engage with the collet mandrel teeth so as to torsionally lock the collet mandrel to the actuator collar;

a ball valve oriented to block downwards flow through the mandrel in a closed position, wherein the ball valve is selectively coupled to rotary motion of the collet mandrel to actuate open in response to rotary motion of the collet mandrel in a first direction and to actuate closed in response to rotary motion of the collet mandrel in a second direction, the second direction opposite of the first direction;

a slider pin comprising a first projection configured to engage with a first surface bore in a ball of the ball valve;

an actuator pin rigidly connected to the actuator collar, wherein the actuator pin comprises a second projection configured to engage with a second surface bore in the ball of the ball valve;

a slider sleeve comprising a longitudinal groove, wherein the slider pin is configured to slide in the longitudinal groove; and a first piston located above the valve and positioned at least partly around an outside of the mandrel, wherein the first piston is configured to develop motive force from a pressure differential between an interior of the mandrel and an exterior of the downhole oilfield tool assembly.

2. The downhole oilfield tool assembly of claim 1, further comprising an expansion mechanism, wherein the first piston is coupled to the expansion mechanism and is operable to deliver motive force to the expansion mechanism.

3. The downhole oilfield tool assembly of claim 2, wherein the expansion mechanism is coupled to a liner hanger, and wherein the first piston is further configured to expand the liner hanger by delivering the motive force to the expansion mechanism.

4. The downhole oilfield tool assembly of claim 1, further comprising a second piston located above the ball valve and positioned at least partly around the outside of the mandrel.

5. The downhole oilfield tool assembly of claim 1, wherein the ball has a hole that is constrained by a first lug coupled to a valve housing, wherein the ball further has a slot that is engaged by a second lug coupled to the mandrel, wherein the second lug is configured to slide in the slot when the mandrel rotates and couple rotation of the mandrel with actuating the valve to open and to close.

6. The downhole oilfield tool assembly of claim 1, wherein the mandrel comprises mandrel teeth, and wherein the downhole oilfield tool assembly further comprises:

an actuator collar comprising actuator collar teeth, wherein the actuator collar teeth engage with the mandrel teeth to limit rotation of the mandrel with respect to the actuator collar between a first rotational position and a second rotational position, wherein the ball valve is configured to be in a closed position in the first rotational position and in an open position in the second rotational position.

7. The downhole oilfield tool assembly of claim 6, wherein the mandrel is configured to transition from the first rotational position to the second rotational position in response to the rotary motion of the mandrel in the first direction.

8. The downhole setting tool of claim 1, wherein the actuator pin and the slider pin are configured to constrain a pitch, a yaw, and a roll of the ball such that the ball valve may be closed by rotating the collet mandrel in a first rotational direction and opened by rotating the collet mandrel in a second rotational direction.

9. A downhole setting tool, comprising:

a ball valve;

a collet mandrel rotatably disposed in the setting tool, the collet mandrel comprising collet mandrel teeth; and an actuator collar comprising actuator collar teeth, wherein the actuator collar teeth are configured to engage with the collet mandrel teeth to limit rotation of the collet mandrel with respect to the actuator collar about a longitudinal axis of the collet mandrel between a first rotational position and a second rotational position, wherein the ball valve is configured to be in a closed position in the first rotational position and in an open position in the second rotational position; and a first piston situated uphole from the ball valve.

10. The downhole setting tool of claim 9, further comprising:

a slider pin comprising a first projection configured to engage with a first surface bore in a ball of the ball valve;

an actuator pin rigidly connected to the actuator collar, the actuator pin comprising a second projection configured to engage with a second surface bore in a ball of the ball valve; and a slider sleeve comprising a longitudinal groove, the slider pin configured to slide in the longitudinal groove.

11. The downhole setting tool of claim 10, wherein the actuator pin and the slider pin are configured to constrain a pitch, a yaw and a roll of the ball such that the ball valve may be closed by rotating the collet mandrel in a first rotational direction and opened by rotating the collet mandrel in a second rotational direction.

12. The downhole setting tool of claim 9, further comprising a second piston situated uphole from the ball valve.

13. The downhole setting tool of claim 9, wherein the ball valve is selectively coupled to rotary motion of the collet mandrel to actuate open in response to rotary motion of the collet mandrel in a first direction and to actuate closed in response to rotary motion of the mandrel in a second direction, the second direction opposite of the first direction.

14. The downhole setting tool of claim 13, wherein the ball valve comprises a ball having a hole that is constrained by a first lug coupled to a valve housing, wherein the ball further has a slot that is engaged by a second lug coupled to the collet mandrel, wherein the second lug is configured to slide in the slot when the collet mandrel rotates and couple rotation of the collet mandrel with actuating the valve to open and to close.

15. A method of setting a liner inside a casing, comprising:

rotating a mandrel component of the setting tool about a longitudinal axis of the mandrel from a first rotational position in a first direction, wherein the mandrel component comprises mandrel teeth;

engaging the mandrel teeth with actuator collar teeth, wherein an actuator collar comprises the actuator collar teeth;

limiting rotation of the mandrel component with respect to the actuator collar about a longitudinal axis of the mandrel between the first rotational position and a second rotational position;

actuating a ball valve to block downwards flow through a setting tool in response to rotating the mandrel component in the first direction to the second rotational position;

developing a pressure differential between an interior of the setting tool above the ball valve and an exterior of the setting tool; and setting the liner inside the casing responsive to the pressure differential.

16. The method of claim 15, wherein setting the liner is performed at least in part by a first piston that applies a downwards force based on the pressure differential, wherein the first piston is located above the ball valve.

17. The method of claim 16, wherein setting the liner is further performed at least in part by a second piston that applies a downwards force based on the pressure differential, wherein the second piston is located above the ball valve.

18. The method of claim 15, after actuating the ball valve to block downwards flow through the setting tool, actuating the ball valve to allow downwards flow through the setting tool.

19. The method of claim 18, wherein actuating the ball valve to allow downwards flow through the setting tool comprises rotating the mandrel component of the setting tool in a second direction, wherein the first direction is opposite the second direction.

20. The method of claim 19, wherein rotating the mandrel component of the setting tool in the second direction comprises rotating the mandrel component of the setting tool to the first position.

* * * * *